United States Patent [19]

Ramesh et al.

[11] Patent Number: 4,968,347

[45] Date of Patent: Nov. 6, 1990

[54] HIGH ENERGY PRODUCT PERMANENT MAGNET HAVING IMPROVED INTRINSIC COERCIVITY AND METHOD OF MAKING SAME

[75] Inventors: Ramamoorthy Ramesh; Gareth Thomas, both of Berkeley, Calif.

[73] Assignee: The United States of America as represented by the United States Department of Energy, Washington, D.C.

[21] Appl. No.: 274,875

[22] Filed: Nov. 22, 1988

[51] Int. Cl.[5] ..... C22C 29/14

[52] U.S. Cl. ..... 75/244; 75/246; 148/103; 148/105; 148/108; 419/12; 419/25; 419/29; 419/32; 419/39; 419/54

[58] Field of Search ..... 419/12, 25, 54, 39, 419/29; 75/244, 245; 148/103, 105, 108

[56] References Cited

U.S. PATENT DOCUMENTS 4,776,902 10/1988 Ghandehari ..... 148/103

*Primary Examiner*—Stephen J. Lechert, Jr.
*Assistant Examiner*—Nina Bhat
*Attorney, Agent, or Firm*—Clifton E. Clouse, Jr.; Roger S. Gaither; William R. Moser

[57] ABSTRACT

A high energy rare earth-ferromagnetic metal permanent magnet is disclosed which is characterized by improved intrinsic coercivity and is made by forming a particulate mixture of a permanent magnet alloy comprising one or more rare earth elements and one or more ferromagnetic metals and forming a second particulate mixture of a sintering alloy consisting essentially of 92–98 wt. % of one or more rare earth elements selected from the class consisting of Gd, Tb, Dy, Ho, Er, Tm, Yb, Lu, and mixtures of two or more of such rare earth elements, and 2–8 wt. % of one or more alloying metals selected from the class consisting of Al, Nb, Zr, V, Ta, Mo, and mixtures of two or more of such metals. The permanent magnet alloy particles and sintering aid alloy are mixed together and magnetically oriented by immersing the mixture in an axially aligned magnetic field while cold pressing the mixture. The compressed mixture is then sintered at a temperature above the melting point of the sintering aid and below the melting point of the permanent magnet alloy to thereby coat the particle surfaces of the permanent magnetic alloy particles with the sintering aid while inhibiting migration of the rare earth element in the sintering aid into the permanent magnet alloy particles to thereby raise the intrinsic coercivity of the permanent magnet alloy without substantially lowering the high energy of the permanent magnet alloy.

28 Claims, 10 Drawing Sheets

HIGH ENERGY PRODUCT PERMANENT MAGNET HAVING IMPROVED INTRINSIC COERCIVITY AND METHOD OF MAKING SAME

BACKGROUND OF THE INVENTION

The invention described herein arose in the course of, or under, Contract No. DE-AC03-76SF00098 between the United States Department of Energy and the University of California.

This invention relates to a high energy permanent magnet having improved intrinsic coercivity. More particularly, this invention relates to high energy permanent magnets comprising sintered iron-rare earth-boron alloy particles having improved intrinsic coercivity and formed by sintering the particles in the presence of a rare earthaluminum alloy having a melting point below the sintering temperature.

In recent years, formation of permanent magnets from alloys of rare earths and ferromagnetic metals such as samarium-cobalt magnets has resulted in the production of stronger magnets having higher intrinsic coercivities than conventional permanent magnet alloys such as the well known AlNiCo permanent magnet alloys formed from aluminum-nickelcobalt alloys.

More recently, even higher residual magnetic strength has been achieved using alloys comprising a rare earth, a transition metal (usually Fe or a Fe-Co alloy), and boron, such as Fe-Nd-B alloys. Such alloys are discussed by C. S. Herget, in an article entitled "Current Patent Situation In The Field Of The Ne Permanent Magnet Material Nd-Fe-B", published on pages 245–258 of "Nd-Fe Permanent Magnets, Their Present and Future Applications", edited by I. V. Mitchell, Elsevier Applied Science Publishers (1985), which describes the disclosures of Fe-Nd-B permanent magnet alloys contained in the Sumitomo Special Metals Company European Patent applications No. EP 0,101,552 A2 and EP 0,106,948 A2; and in the General Motors Corporation European Patent application No. EP 0,108,474,A2.

Such alloys may have a large value of room temperature saturation magnetization of up to 1.6 Tesla, a high intrinsic coercivity of up to 13 kOe, and a consequent high energy product of up to 45 MGOe. However, the Curie temperature is relatively low, e.g., 312° C. for Fe-Nd-B, and the temperature coefficients of remanence and intrinsic coercivity are quite high which means that considerable irreversible losses can occur at temperatures of 125°–150° C. This limits the potential applications of such magnets, despite their high energy product.

It would, therefore, be desirable to improve the room temperature intrinsic coercivity since this would also lead to a higher value at elevated temperatures as well and would mean that the magnet would be more resistant to demagnetization at higher temperatures.

Ghandehari U.S. Pat. No. 4,601,754 describes the improvement of the coercivities of permanent magnets formed from alloys containing rare earths and ferromagnetic metals, in ratios of $RM_2$, $RM_5$, $R_2M_7$, and $R_2M_{17}$ and other alloys, which comprises the use of a sintering aid together with an additive material selected from the group comprising refractory oxides, carbides, and nitrides. The sintering aids are also rare earth ferromagnetic metal alloys which may contain the same or different metals as in the major phase alloy. The proportions of the component metals for the sintering aid are chosen so that the sintering aid will be at least partially liquid at the chosen sintering temperature. The sintering aid is said to be preferably a rare earth-ferromagnetic metal alloy which contains an excess of rare earth over that required for $RM_5$ compositions.

European Patent application EP No. 0,237,416 describes increasing the coercive force of a Fe-Nd-B permanent magnet by mixing particles of a first permanent magnet alloy, such as Fe-Nd-B, with a particulate second alloy containing 30 to 86 wt.% of a heavy rare earth element selected from gadolinium, terbium, dysprosium, holmium, erbium, thulium, ytterbium, and lutetium and the balance selected from the group comprising aluminum, niobium, zirconium, vanadium, tantalum, and molybdenum. The patentee states that during the sintering process the additive elements diffuse into the particles of the matrix phase from the surface of the particles, but never reach the core portions of the particles. The patentees state that the concentration is high only at the surface of the matrix particles and substantially absent in the core portion of the matrix particles. The sintering temperature given in the example is 1050° C.

While the addition of dysprosium to an Fe-Nd-B alloy will increase the room temperature intrinsic coercivity considerably, the sintering of a powdered mixture of an Fe-Nd-B alloy and an alloy containing dysprosium, where both alloys are in particulate form, as in EP application No. 0,237,416, can result in the solid state migration of dysprosium atoms into the Fe-Nd-B particles, resulting in a reduction in the saturation magnetization, and hence the remanence, of the Fe-Nd-B magnet since dysprosium, unlike neodymium, couples antiparallel to the iron sub-lattice magnetization.

It would, therefore, be desirable to increase the intrinsic coercivity of a rare earth-ferromagnetic permanent magnet alloy, such as an Fe-Nd-B alloy, by coating particles of such a permanent magnet alloy in a manner which will increase the intrinsic coercivity of the permanent magnet alloy, while having a minimal effect on the remanence and energy product of the permanent magnet alloy.

SUMMARY OF THE INVENTION

It is, therefore, an object of this invention to form a rare earth-ferromagnetic permanent magnet alloy comprising rare earth-ferromagnetic permanent magnet alloy particles coated with a rare earth-containing alloy which forms a liquid at the sintering temperature and which is capable of increasing the intrinsic coercivity of the permanent magnet alloy without substantially decreasing the remanence of the permanent magnet alloy.

It is a further object of this invention to form a rare earth-ferromagnetic permanent magnet alloy comprising rare earth-ferromagnetic permanent magnet alloy particles coated with a rare earth-containing alloy which forms a liquid at the sintering temperature and which is capable of increasing the intrinsic coercivity of the permanent magnet alloy without substantially decreasing the remanence of the permanent magnet alloy wherein the rare earth-containing alloy comprises one or more rare earth elements alloyed with another metal which does not decrease the remanence of the permanent magnet alloy in an alloy ratio which forms a minimum melting point.

It is another object of this invention to provide a method of making a rare earth-ferromagnetic permanent magnet alloy comprising rare earth-ferromagnetic permanent magnet alloy particles coated with a rare earth-containing alloy which forms a liquid at the sintering temperature and which is capable of increasing the intrinsic coercivity of the permanent magnet alloy without substantially decreasing the remanence of the permanent magnet alloy comprising the steps of forming a particulate mixture of a rare earth-ferromagnetic permanent magnet alloy and a sintering aid comprising an alloy containing a rare earth element capable of raising the intrinsic coercivity of the rare earth-ferromagnetic permanent magnet alloy and sintering the particulate mixture at a temperature above the melting point of the sintering aid but below the melting point of the permanent magnet alloy to inhibit migration of the rare earth in the sintering aid into the permanent magnet alloy.

These and other objects of the invention will be apparent from the following description and drawings.

DETAILED DESCRIPTION OF THE INVENTION

Figure 1:
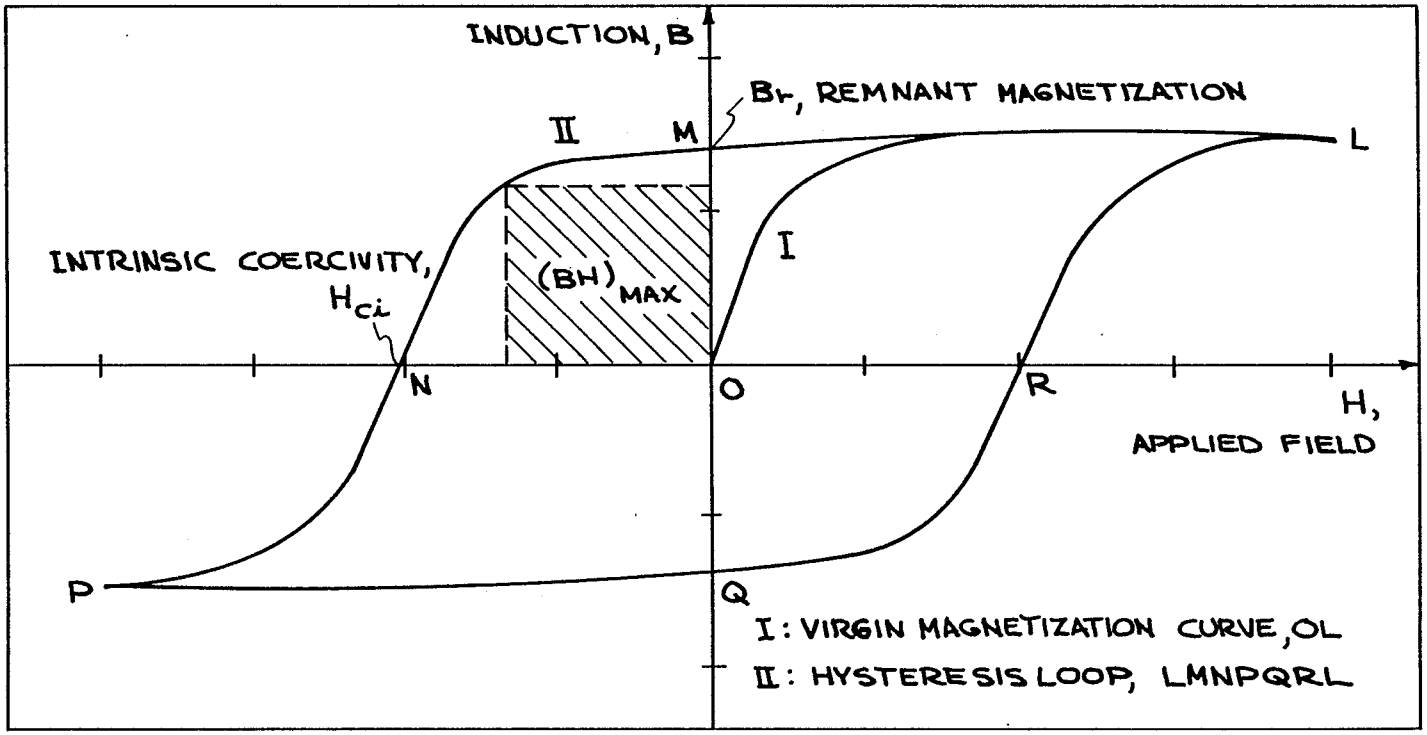
FIG. 1 is a schematic representation of the virgin magnetization curve and the hysteresis loop for a typical prior art nucleation controlled sintered permanent magnet such as a Fe-Nd-B magnet with the various properties of interest in designing a permanent magnet shown.
Figure 2A:
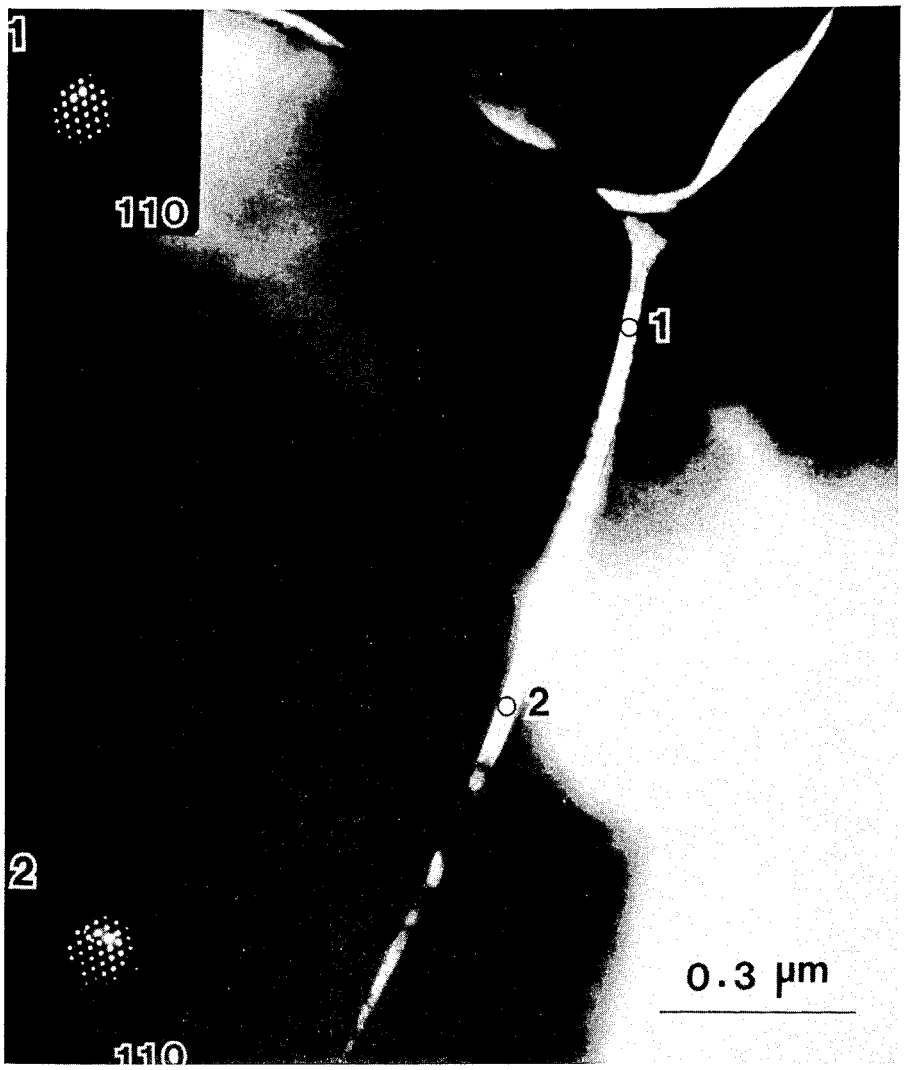
FIG. 2A is a transmission electron micrograph depicting the details of the microstructure of prior art sintered Fe-Nd-B wherein the dark regions are the matrix $RE_2Fe_{14}B$ phase while the grain boundary fcc phase is seen in bright contrast
Figure 2B:
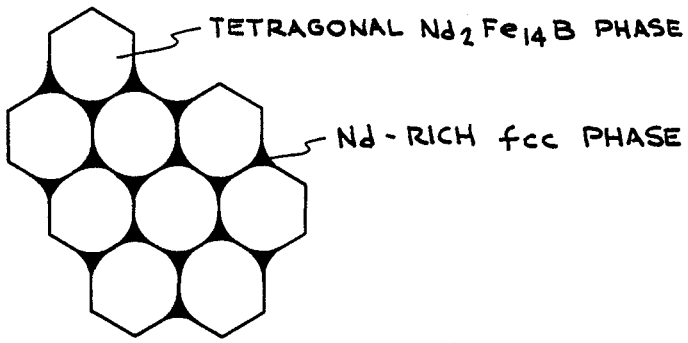
FIG. 2B (PRIOR ART)
FIG. 2B is a schematic representation of the overall microstructure of prior art sintered magnets.
Figure 3:
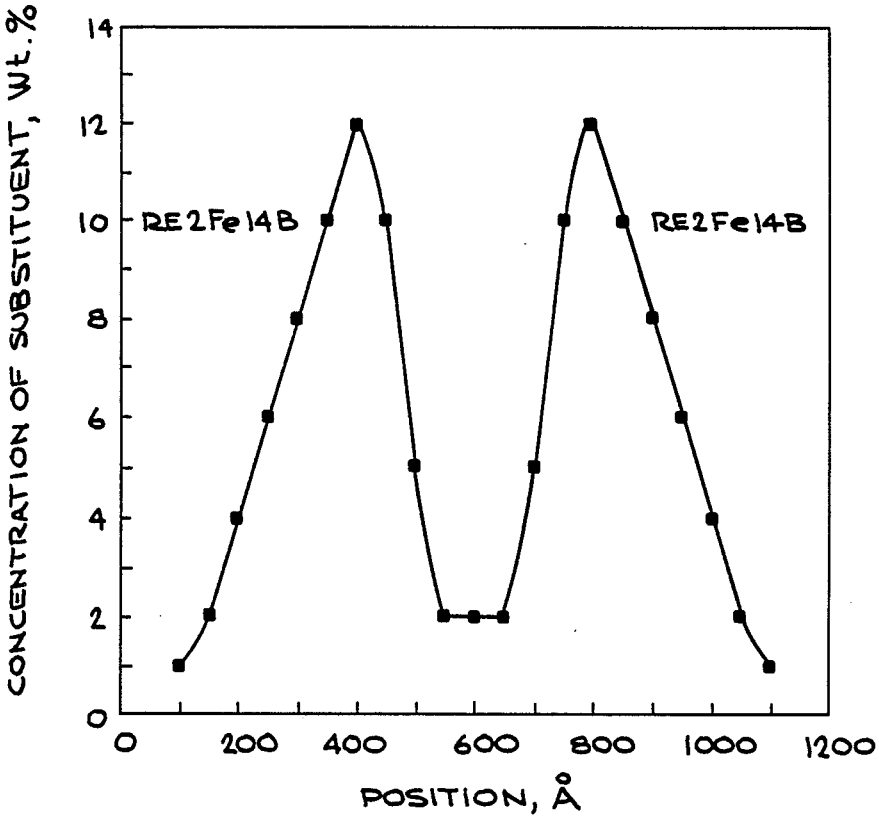
FIG. 3 is a schematic representation of the preferred distribution of the substituent species in the microstructure of the permanent magnet constructed in accordance with the invention.

The invention provides a sintered permanent magnet having a high energy product, high remanence, and enhanced intrinsic coercivity comprising the sintered product of particulate permanent magnet alloy comprising a rare earth and a ferromagnetic element or alloy coated with a sintering aid alloy capable of increasing the intrinsic coercivity of the permanent magnet alloy and consisting essentially of one or more rare earth metal elements alloyed with one or more additional elements to lower the melting point of the sintering aid alloy. The permanent magnet is formed by sintering a particulate mixture of the permanent magnet alloy and the sintering aid alloy at a temperature above the melting point of the sintering aid alloy but below the melting temperature of the permanent magnet alloy to inhibit diffusion of the rare earth element or elements from the sintering aid alloy into the permanent magnet alloy particles.

The permanent magnet alloy may comprise an alloy having a formula RME where R comprises one or more rare earths selected from the class consisting of lanthanum, cerium, praseodymium, neodymium, and samarium; M comprises one or more ferromagnetic metals selected from the class consisting of iron, cobalt, nickel, and combinations of these metals; and E comprises an optional additional element such as, for example, boron, molybdenum, titanium, or vanadium. Preferably, the ferromagnetic metal comprises iron, cobalt, or a mixture of the two metals.

The ratios of the rare earth element or elements, ferromagnetic metal element or elements, and optional additional element may range from about 30 to 50 wt.% of the rare earth element or elements and 50 to 70 wt.% of the ferromagnetic metal or metals. The optional third element may be present in an amount of from about 1–1.6 wt.%.

In a particularly preferred embodiment, the permanent magnet alloy comprises a Fe-Nd-B alloy wherein the amount of Nd ranges from about 33–41 wt.%, and the amount of boron ranges from 1–1.6 wt.% with the balance consisting essentially of iron and incidental impurities.

The sintering aid alloy may comprise a mixture of one or more alloying elements and one or more rare earth elements capable of raising the intrinsic coercivity of the permanent magnet alloy and capable of alloying with the alloying element or elements to lower the melting point of the resulting sintering aid alloy to a temperature below the temperature which will be used to sinter the particulate mixture of the permanent magnet alloy and sintering aid alloy. Preferably, the alloying element or elements will lower the melting point of the resulting sintering aid alloy down to about 100° C. below the sintering temperature of the permanent magnet alloy/sintering aid alloy mixture.

The rare earth element in the sintering aid alloy is selected from the class consisting of gadolinium, terbium, dysprosium, holmium, erbium, thulium, ytterbium, lutetium, and a mixture of two or more of such rare earth elements. The other alloying element is selected from the class consisting of aluminum, niobium, zirconium, vanadium, tantalum, molybdenum, and a mixture of two or more of such alloying elements.

Figure 9:
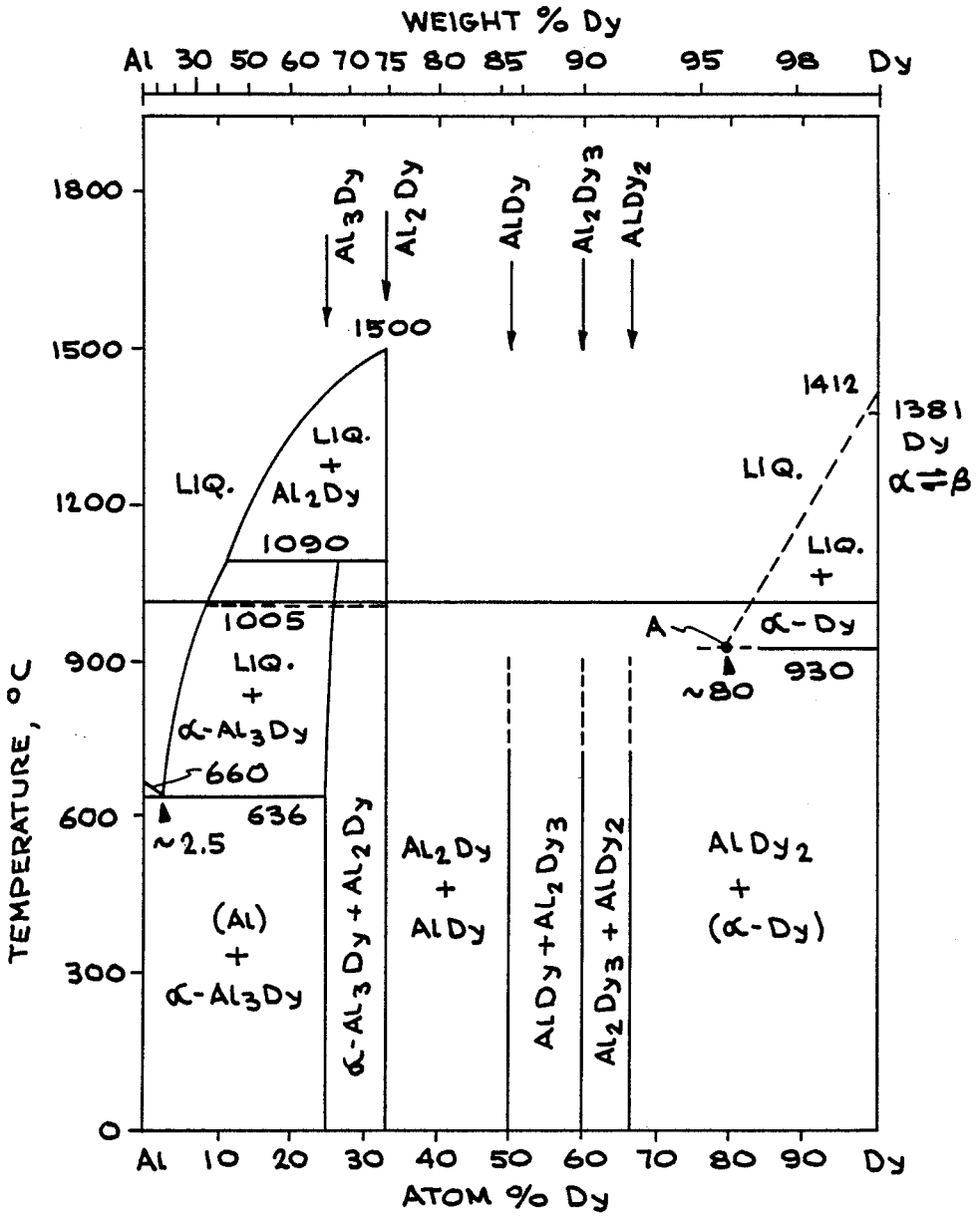
FIG. 9 is a graph showing the melting point of a Dy-Al alloy as a function of the concentration of the alloying constituents.

In a preferred embodiment, the sintering aid alloy may comprise a mixture of dysprosium and aluminum, preferably in a eutectic mixture of about 94 to 98 wt.% dysprosium and 2 to 6 wt.% aluminum. Most preferably, the sintering aid alloy comprises about 9 wt.% dysprosium and about 4 wt.% aluminum. As shown at point A in the graph of FIG. 9, an alloy consisting of about 96 wt.% dysprosium and about 4 wt.% aluminum will have a minimum melting temperature of about 910°-920° C.

The desired permanent magnet alloy may be formed by mixing together the alloying constituents; heating the mixture, for example, by induction heating in a vacuum, sufficiently to form a molten mass; cooling and solidifying the alloy; and then particularizing the alloy, for example, by ball milling, to a particle size of from about 1-10 microns, preferably about 3-5 microns, and typically about 4 microns. If necessary to aid in particularizing, the cooled ingot may be hydrided prior to particularization by flowing $H_2$ over the ingot for a period of time, for example, for about 6-12 hours to embrittle the material.

The sintering aid alloy may be similarly formed by melting its alloying constituents together, for example, in an induction furnace under vacuum; cooling and solidifying the mixture; and then particularizing the solidified mass to a particle size of about 1-5 microns, preferably 1-3 microns, and typically about 2 microns. The sintering aid alloy may also be hydrided prior to particularization to embrittle the alloy as a assist to particularization.

The permanent magnet alloy particles and sintering alloy particles are then mixed together in a ratio of about 1 to 8 wt.% sintering aid, preferably 1.5 to 4 wt.% sintering aid with the balance consisting essentially of the permanent magnet alloy. The particles are thoroughly mixed together and then magnetically aligned in an axial magnetic field of from about 35-45 kOe, preferably about 40 kOe, and then cold pressed, at a pressure of from about 180 to about 220 MPa, preferably about 190 to about 210 MPa, and nominally about 200 MPa, into the desired shape while maintaining the shaped particle mass in the magnetic alignment field.

The shaped particulate mass is then sintered at a temperature of about 900 to about 1100° C., preferably about 1050°-1100° C. for a period of about 1-3 hours, preferably at least about 3 hours, preferably in a vacuum or inert atmosphere such as argon, at a pressure of about $10^{-4}$ to $10^{-5}$ Torr. The sintering may, however, be carried out in a reducing atmosphere such as an $H_2$ atmosphere.

After sintering, the sintered mass may be allowed to cool to room temperature or it may be annealed at a temperature of from about 500° to about 650° C. for period of from about 1 to 10 hours. While the annealing step is optional, annealing may be necessary if the product is water quenched after the sintering step.

The following example will serve to further illustrate the invention. A mixture of 64 wt.% Fe, 35 wt.% Nd, and 1 wt.% B, comprising the constituents of the permanent magnet alloy was melted, solidified, hydrided, and then ball milled to an average particle size of 4 microns. A second mixture of 96 wt.% dysprosium and 4 wt.% aluminum, comprising the sintering aid alloy, was also melted, solidified, hydrided, and then ball milled to an average particle size of about 2 microns. 8 wt.% of the sintering aid particles was mixed with 92 wt.% of the permanent magnet alloy by ball milling for about 6 hours and the particle mix was then placed in a press and compacted under a pressure of about 200 MPa at ambient temperature while immersing the particles in an axial magnetic field of about 40 kOe. The resulting compact was then vacuum sintered at temperature of 1050° C. for 3 hours and then allowed to cool to room temperature.

Figure 5A:
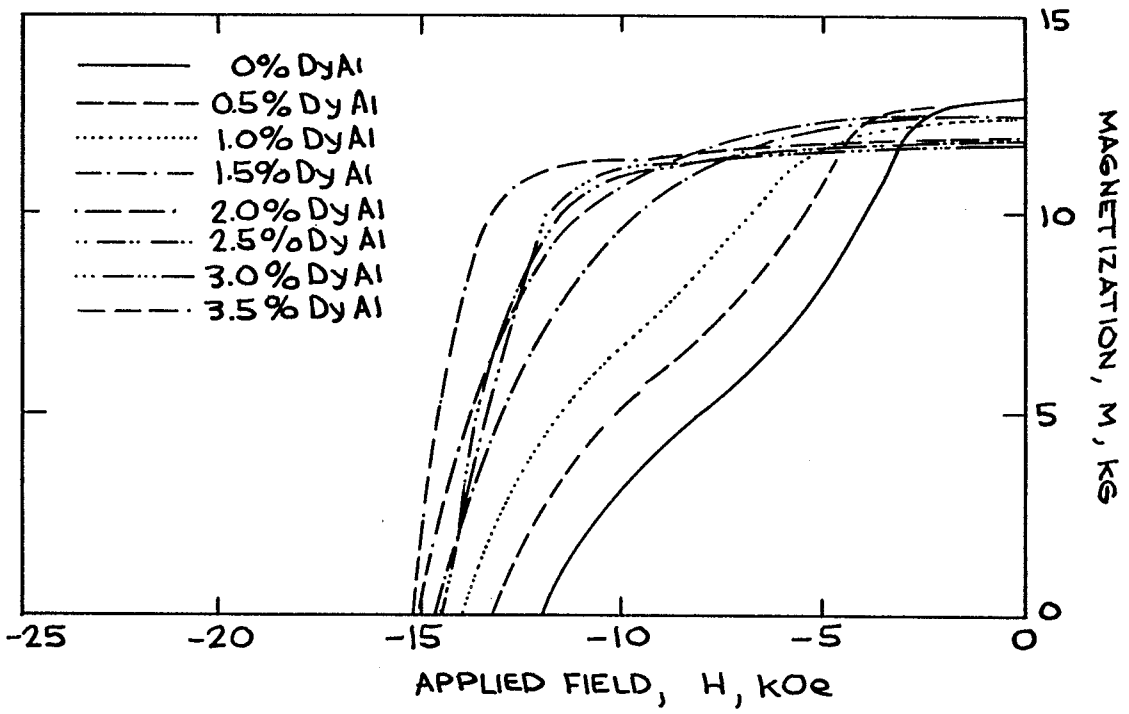
FIG. 5A is a graph showing a set of second quadrant hysteresis loops of magnets prepared with different amounts of a 96 wt.% Dy 4 wt.% Al sintering aid alloy up to 3.5 wt.%, with the balance consisting essentially of the Fe-Nd-B permanent magnet alloy.
Figure 5B:
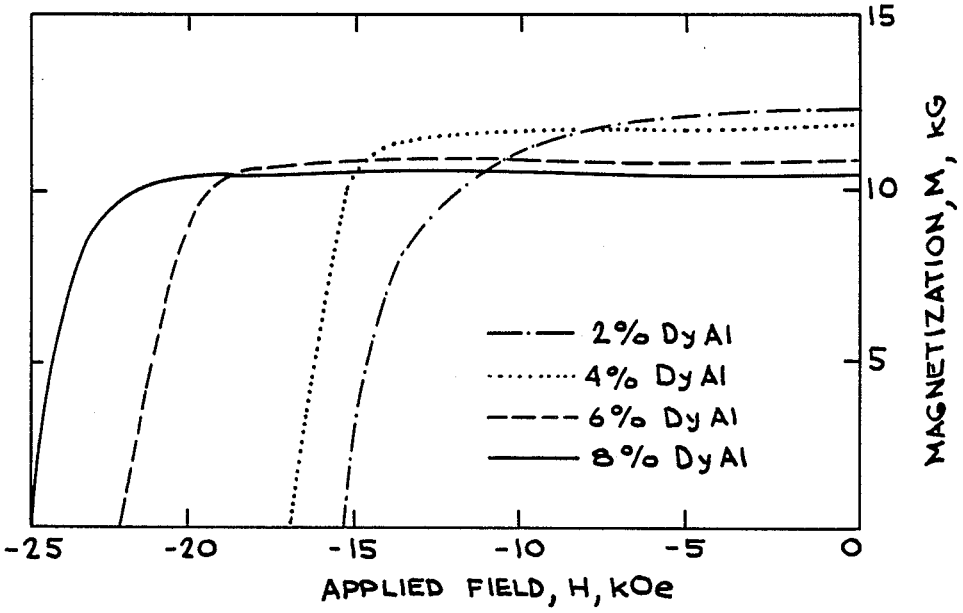
FIG. 5B is a graph showing a set of second quadrant hysteresis loops of magnets prepared with different amounts of a 96 wt.% Dy 4 wt.% Al sintering aid alloy up to 8 wt.%, with the balance consisting essentially of the Fe-Nd-B permanent magnet alloy.
Figure 7A:
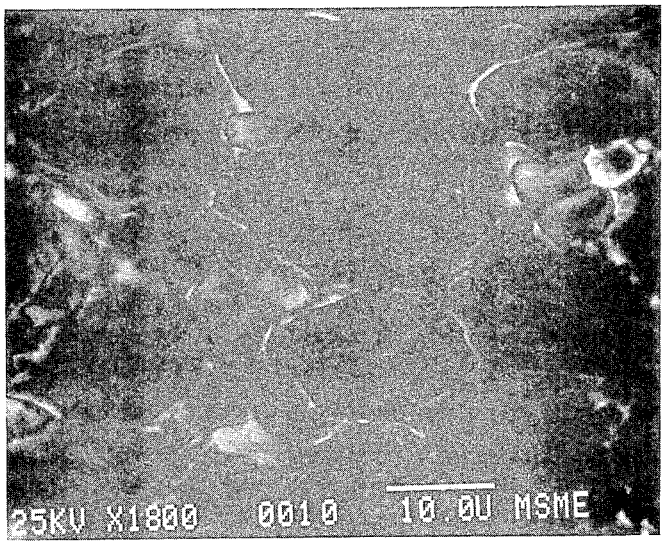
FIG. 7A is a back scattered scanning electron micrograph of a Fe-Nd-B magnet with 8 wt.% of a 96 wt.% Dy 4 wt.% Al sintering aid alloy, showing the regions rich in the rare earth as regions of bright contrast.
Figure 7B:
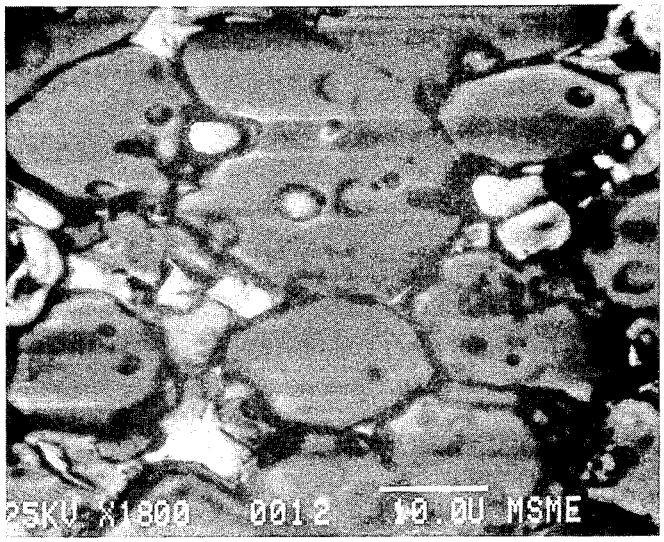
FIG. 7B is a back scattered scanning electron micrograph of a Fe-Nd-B magnet with 8 wt.% of a 96 wt.% Dy 4 wt.% Al sintering aid alloy, showing the secondary electron image corresponding to the regions shown in FIGS. 7(A).
Figure 8A:
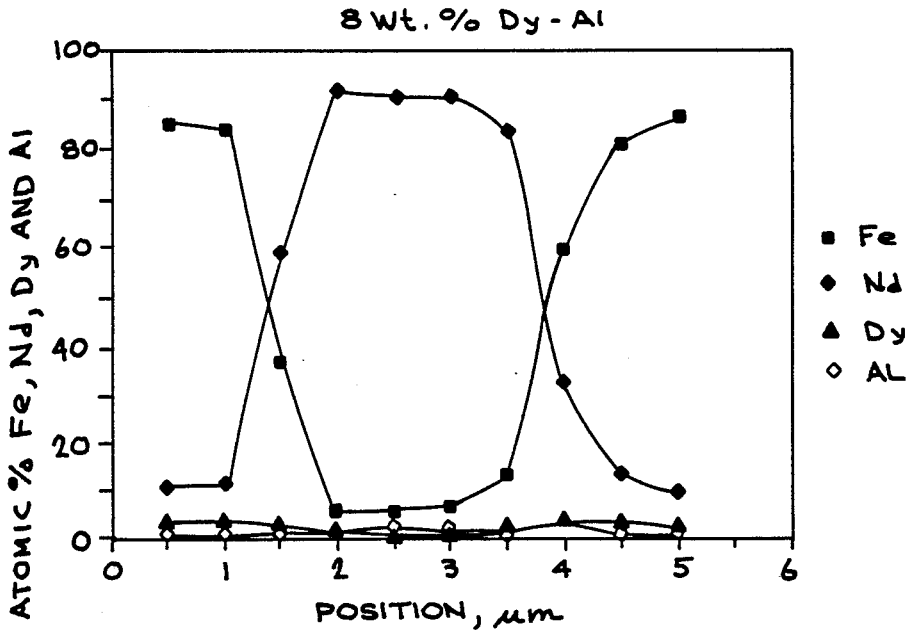
FIG. 8A is a microanalytical line trace across the $RE_2Fe_{14}B$ phase-fcc phase interface for a magnet with 8 wt.% of 96 wt.% Dy 4 wt.% Al sintering aid alloy depicting the segregation of Dy and Al close to the interfaces.
Figure 8B:
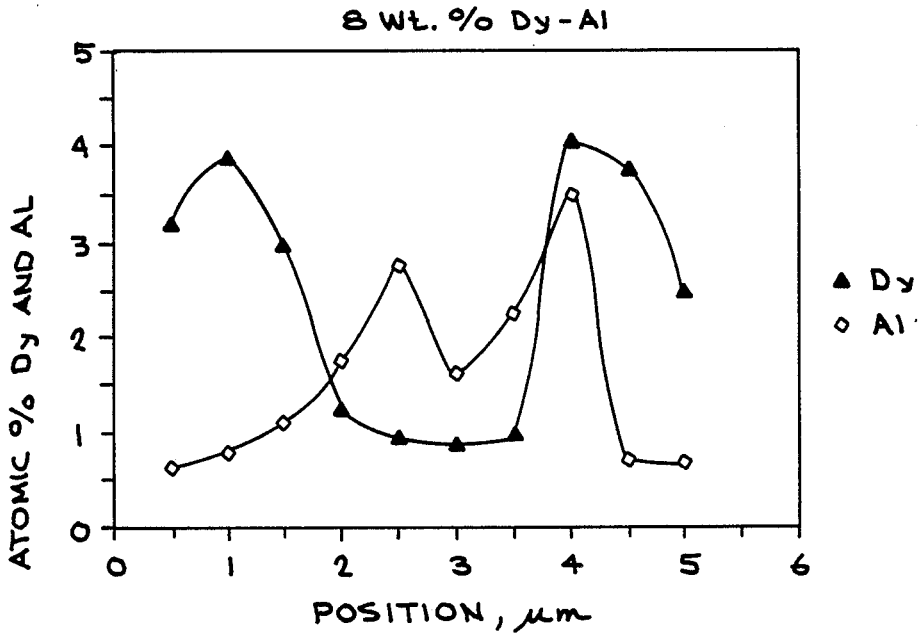
FIG. 8B is a magnification of the bottom portion of FIG. 8A to show the dysprosium and aluminum lines more clearly.

The resulting magnet was then immersed in an applied magnetic field ranging up to 25 kOe and the magnetization H measured as shown in FIG. 5B. FIGS. 7A and 7B, respectively, show back scattered scanning electron micrographs of the sample showing the regions rich in the rare earth as regions of bright contrast and showing the concentration of the rare earth in the sintering aid at the particle interfaces, while FIG. 7B is the secondary electron image of the region shown in FIG. 7A. FIGS. 8A and 8B also show the segregation of the sintering aid a the particle interfaces.

Figure 4A:
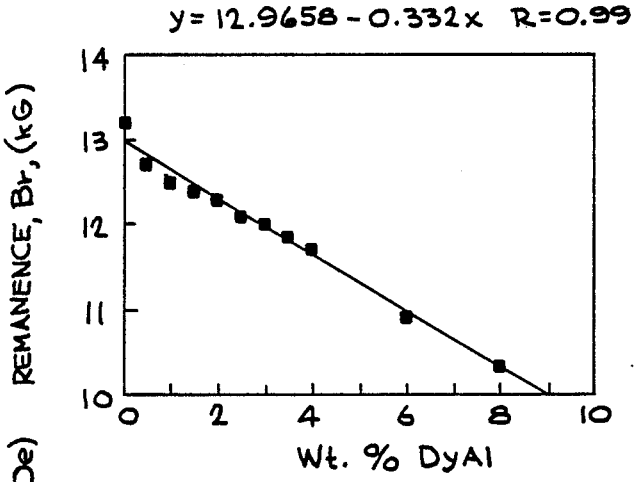
FIG. 4A is a plot of remanence as a function of a 96 wt.% Dy 4 wt.% Al sintering aid alloy.
Figure 4B:
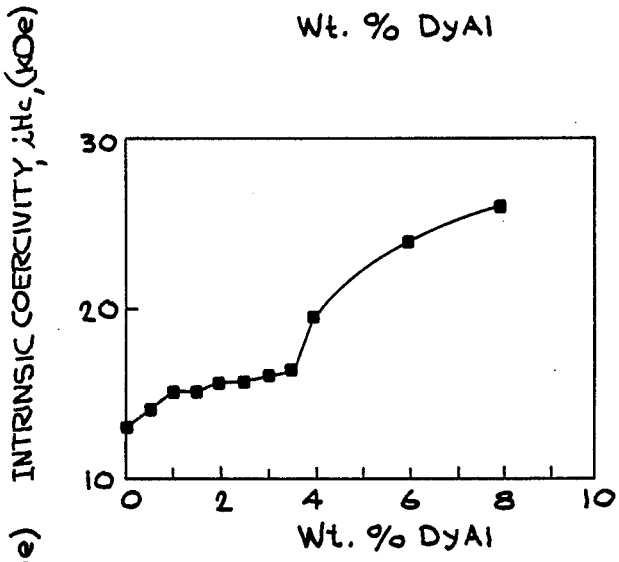
FIG. 4B is a plot of intrinsic coercivity as a function of a 96 wt.% Dy 4 wt.% Al sintering aid alloy.
Figure 4C:
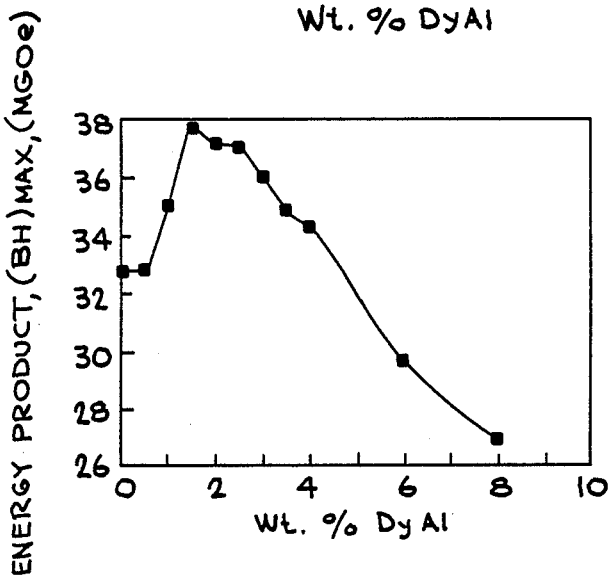
FIG. 4C is a plot of energy product as a function of a 96 wt.% Dy 4 wt.% Al sintering aid alloy.
Figure 6A:
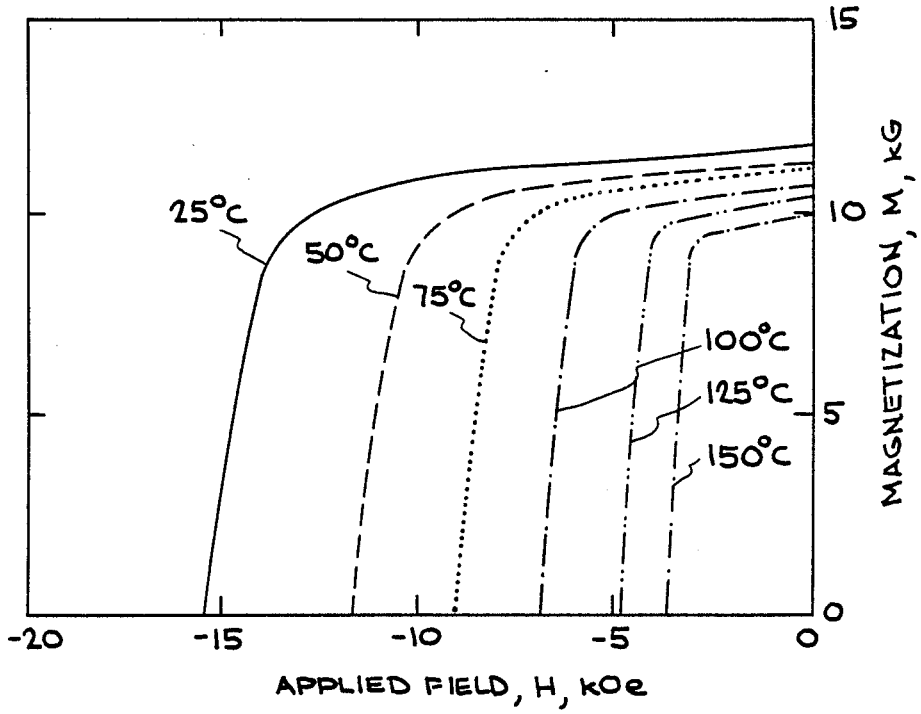
FIG. 6A is a graph showing a set of second quadrant hysteresis loops at different temperatures for a magnet prepared with 3.5 wt.% of a 96 wt.% Dy 4 wt.% Al sintering aid alloy, with the balance consisting essentially of the Fe-Nd-B permanent magnet alloy.
Figure 6B:
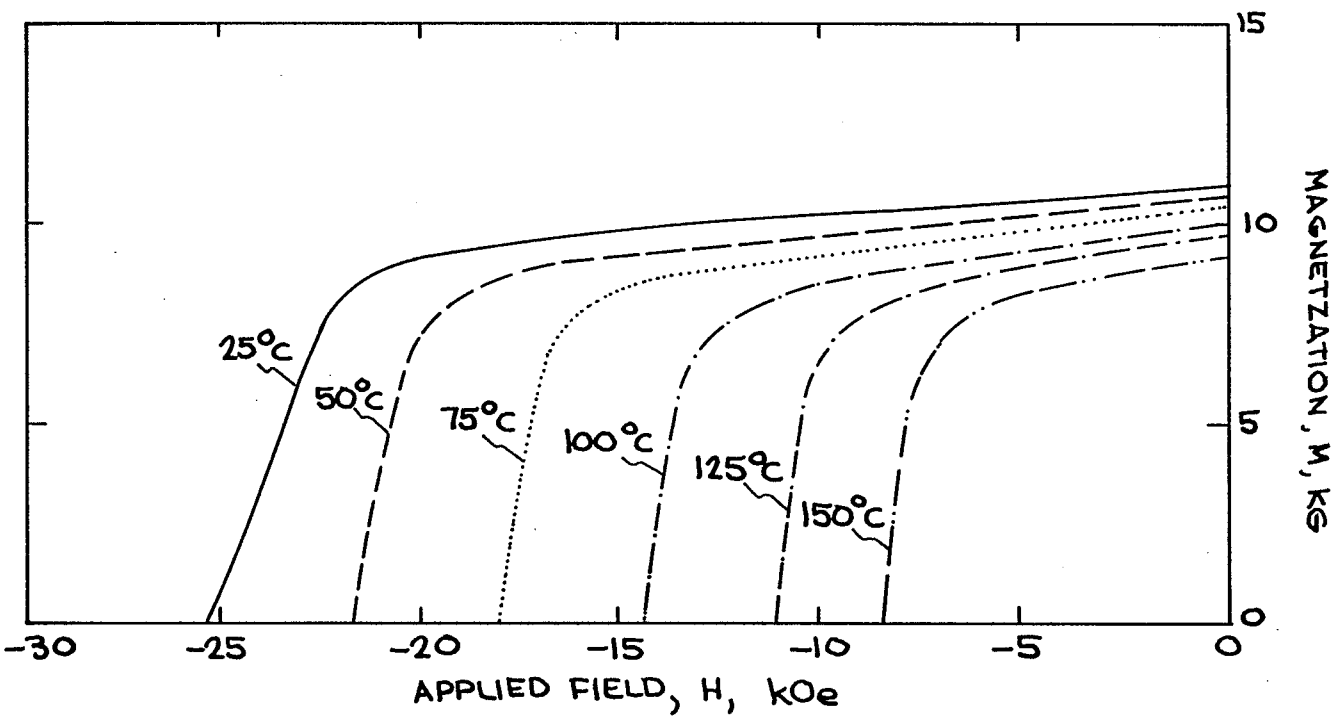
FIG. 6B is a graph showing a set of second quadrant hysteresis loops at different temperatures for a magnet prepared with 6 wt.% of a 96 wt.% Dy 4 wt.% Al sintering aid alloy, with the balance consisting essentially of the Fe-Nd-B permanent magnet alloy.

Additional samples were made using the same permanent magnet and sintering aid particle mixes with the ratios of permanent magnet alloy/sintering aid alloy varying from 0.5, 1.0, 1.5, 2.0, 2.5, 3.0, 3.5, 4.0, and 6.0 wt.% sintering aid. The effects on remanence, intrinsic coercivity, and energy product, based on the various ratios of sintering aid are plotted in FIG. 4, while the magnetization of the samples are plotted in FIGS. 5A and 5B. FIG. 6A shows the hysteresis loops of the sintering aid while FIG. 6B plots similar results for a magnet with 6 wt.% of the sintering aid.

Thus, the invention provides an improved permanent magnet wherein sintering, at a sintering temperature above the melting point of a sintering aid alloy, a particulate mass of a high remanence and high energy product rare earth-ferromagnetic permanent magnet alloy and a sintering aid alloy containing one or more rare earth elements capable of raising the intrinsic coercivity of the permanent magnet alloy results in an improved permanent magnet wherein the rare earth element or elements in the sintering aid are inhibited from diffusing into the particles of the permanent magnet alloy to thereby preserve the high remanence and high energy product of the permanent magnet alloy.

While a specific embodiment of the improved permanent magnet of the invention has been illustrated and method described for carrying out the process in accordance with this invention, modifications and changes of the apparatus, process parameters, materials, etc. will become apparent to those skilled in the art, and it is intended to cover in the appended claims all such modifications and changes which come within the scope of the invention.

What is claimed is:

1. A method of making a high energy permanent magnet characterized by improved intrinsic coercivity which comprises:

(a) forming a particulate mixture of a permanent magnet alloy comprising one or more rare earth elements and one or more ferromagnetic metals;

(b) forming a particulate mixture of a sintering alloy consisting essentially of:

(i) 92–98 wt.% of one or more rare earth elements selected from the class consisting of Gd, Tb, Dy, Ho, Er, Tm, Yb, Lu, and mixtures of two or more of such rare earth elements, and;

(ii) 2–8 wt.% of one or more alloying metals selected from the class consisting of Al, Nb, Zr, V, Ta, Mo, and mixtures of two or more of such metals;

(c) forming a particulate mixture of said particulate permanent magnet alloy and said particulate sintering aid alloy;

(d) magnetically orienting said particulate mixture by immersing the mixture in an axially aligned magnetic field; and (e) sintering the magnetically aligned particulate mixture at a temperature above the melting point of said sintering aid and below the melting point of said permanent magnet alloy;

to thereby coat the particle surfaces of said permanent magnetic alloy particles with said sintering aid while inhibiting migration of the rare earth element in said sintering aid into said permanent magnet alloy particles to thereby raise the intrinsic coercivity of said permanent magnet alloy without substantially lowering the high energy of said permanent magnet alloy.

2. The method of claim 1 wherein said step of forming a particulate mixture of said particulate permanent magnet alloy and said particulate sintering aid alloy further comprises mixing together from about 92 to about 99 wt.% permanent magnet alloy and from about 1 to about 8 wt.% of said sintering aid alloy.

3. The method of claim 1 wherein said step of forming a particulate mixture of said particulate permanent magnet alloy and said particulate sintering aid alloy further comprises mixing together from about 96 to about 99 wt.% permanent magnet alloy and from about 1 to about 4 wt.% of said sintering aid alloy.

4. The method of claim 1 wherein said step of forming said particulate permanent magnet alloy further comprises mixing together from about 30 to about 50 wt.% of one or more rare earth elements selected from the class consisting of La, Ce, Pr, Nd, Sm, and mixtures of two or more of such rare earth elements with from about 50 to about 70 wt.% of one or more ferromagnetic metals selected from the class consisting of Fe, Co, Ni, and mixtures of two or more of such ferromagnetic metals.

5. The method of claim 4 wherein said step of forming said particulate permanent magnet alloy further comprises mixing with said one or more rare earth elements and said one or more ferromagnetic metals from 0 to about 2 wt.% of one or more additional elements selected from the class consisting of B, Mo, Ti, and V.

6. The method of claim 4 wherein said step of forming said particulate permanent magnet alloy further comprises mixing Nd with said one or more ferromagnetic metals.

7. The method of claim 4 wherein said step of forming said particulate permanent magnet alloy further comprises mixing with said one or more rare earth elements one or more ferromagnetic elements selected from the class consisting of Fe, Co, and mixtures of Fe and Co.

8. The method of claim 4 wherein said step of forming said particulate permanent magnet alloy further comprises mixing Fe with said one or more rare earth elements.

9. The method of claim 4 wherein said step of forming said particulate permanent magnet alloy further comprises mixing B with said one or more rare earth elements and said one or more ferromagnetic metals.

10. The method of claim 4 wherein said step of forming said particulate permanent magnet alloy further comprises mixing from 0 to about 2 wt.% B with from about 33 to about 41 wt.% Nd and from about 59 to about 67 wt.% Fe.

11. The method of claim 1 including the further step of cold pressing said particulate mixture of said permanent magnet alloy and said sintering aid alloy prior to sintering said particulate mixture.

12. The method of claim 11 wherein said step of cold pressing said particulate mixture further comprises compressing said particulate mixture at a pressure of from about 180 to about 220 MPa.

13. The method of claim 1 wherein said step of magnetically orienting said particulate mixture by immersing the mixture in a axially aligned magnetic field further comprises immersing said particulate mixture in a magnetic field of from about 35 to about 45 kOe.

14. The method of claim 1 wherein said sintering step is carried out at temperature of from about 900° to about 1100° C. for a period of from about 1 to about 3 hours.

15. The method of claim 14 wherein said sintering step is carried out at a temperature of from about 1050° to about 1100° C.

16. The method of claim 14 including the further step of cooling the sintered permanent magnet back to room temperature.

17. The method of claim 14 including the further step of annealing the sintered permanent magnet at a temperature of from about 500° to about 650° C. for period of from about 1 to about 10 hours.

18. A method of making a high energy permanent magnet characterized by improved intrinsic coercivity which comprises:

(a) forming a particulate mixture of a permanent magnet alloy consisting essentially of:

(i) from about 30 to about 50 wt.% of one or more rare earth elements selected from the class consisting of La, Ce, Pr, Nd, Sm, and mixtures of two or more of such rare earth elements;

(ii) from about 50 to about 70 wt.% of one or more ferromagnetic metals selected from the class consisting of Fe, Co, Ni, and mixtures of two or more of such ferromagnetic metals; and (iii) from 0 to about 2 wt.% of one or more additional elements selected from the class consisting of B, Mo, Ti, and V;

(b) forming a particulate mixture of a sintering alloy consisting essentially of:

(i) 92–98 wt.% of one or more rare earth elements selected from the class consisting of Gd, Tb, Dy, Ho, Er, Tm, Yb, Lu, and mixtures of two or more of such rare earth elements, and;

(ii) 2–8 wt.% of one or more alloying metals selected from the class consisting of Al, Nb, Zr, V, Ta, Mo, and mixtures of two or more of such metals;

(c) forming a particulate mixture of from about 92 to about 99 wt.% of said particulate permanent magnet alloy and from about 1 to about 8 wt.% of said particulate sintering aid alloy;

(d) magnetically orienting said particulate mixture by immersing the mixture in an axially aligned magnetic field of from about 35 to about 45 kOe;

(e) cold pressing said particulate mixture at a pressure of from about 180 to about 220 MPa while maintaining said particulate mixture immersed in said magnetic field; and (f) sintering said magnetically aligned particulate mixture for a period of from about 1 to about 3 hours at a temperature above the melting point of said sintering aid and below the melting point of said permanent magnet alloy;

to thereby coat the particle surfaces of said permanent magnetic alloy particles with said sintering aid while inhibiting migration of the rare earth element in said sintering aid into said permanent magnet alloy particles to thereby raise the intrinsic coercivity of said permanent magnet alloy without substantially lowering the high energy of said permanent magnet alloy.

19. A high energy permanent magnet having improved coercivity comprising sintered particles of an RE-M-E permanent magnet alloy coated with a sintering aid alloy comprising one or more rare earth elements and having a melting point below the sintering temperature, wherein RE comprises one or more rare earth elements selected from the class consisting of La, Ce, Pr, Nd, Sm, and mixtures of two or more of such rare earth elements; M is one or more ferromagnetic metals selected from the class consisting of Fe, Co, Ni, and mixtures of two or more of such metals; and E is an optional additional element selected from the class consisting of B, Mo, Ti, and V.

20. The high energy permanent magnet of claim 19 wherein said one or more rare earth elements in said sintering aid alloy are selected from the class consisting of Gd, Tb, Dy, Ho, Er, Tm, Yb, Lu, and mixtures of two or more of such rare earth elements.

21. The high energy permanent magnet of claim 20 wherein said one or more rare earth elements in said alloy is alloyed with one or more metals selected from the class consisting of Al, Nb, Zr, V, Ta, Mo, and mixtures of two or more of such metals.

22. The high energy permanent magnet of claim 21 wherein the ratio of said one or more rare earth elements to said one or more metals in said sintering aid alloy consists essentially of from about 92 to about 98 wt.% of said one or more rare earth elements and from about 2 to about 8 wt.% of said one or more alloying metals.

23. The high energy permanent magnet of claim 19 wherein the ratio of said permanent magnet alloy to said sintering aid alloy is from about 92 to about 99 wt.% permanent magnet alloy and from about 1 to about 8 wt.% sintering aid alloy.

24. The high energy permanent magnet of claim 23 wherein the ratio of said permanent magnet alloy to said sintering aid alloy is from about 96 to about 99 wt.% permanent magnet alloy and from about 1 to about 4 wt.% sintering aid alloy.

25. The high energy permanent magnet of claim 24 wherein said one or more rare earth elements RE of said permanent magnet alloy comprise from about 30 to about 50 wt.% of said permanent magnet alloy, said ferromagnetic metal comprises from about 50 to about 70 wt.% of said permanent magnet alloy, and said additional element E comprises from about 1 to about 1.6 wt.% of said permanent magnet alloy.

26. The high energy permanent magnet of claim 25 wherein said one or more rare earth elements RE of said permanent magnet alloy consists essentially of Nd, said ferromagnetic metal is selected from the class consisting essentially of Fe, Ni, and mixtures of same, and said additional element E consists essentially of B.

27. The high energy permanent magnet of claim 26 wherein said ferromagnetic metal consists essentially of Fe.

28. A high energy permanent magnet having improved intrinsic coercivity comprising coated particles of a permanent magnet alloy sintered with a sintering aid alloy at a temperature above the melting point of the sintering aid alloy to thereby coat said particles with said sintering aid alloy; said permanent magnet alloy having the formula REME wherein RE comprises from about 30 to about 50 wt.% of one or more rare earth elements selected from the class consisting of Gd, Tb, Dy, Ho, Er, Tm, Yb, Lu, and mixtures of two or more of such rare earth elements; M comprises from about 50 to about 70 wt.% of one or more ferromagnetic metals selected from the class consisting of Fe, Co, Ni, and a mixture of two or more of said metals; and E comprises from 0 to about 2 wt.% of B; said sintering aid alloy comprises from about 92 to about 98 wt.% of a rare earth selected from the class consisting of Gd, Tb, Dy, Ho, Er, Tm, Yb, Lu, and mixtures of two or more of such rare earth elements; and from about 2 to about 8 wt.% of one or more metals selected from the class consisting of Al, Nb, Zr, V, Ta, Mo, and mixtures of two or more of such metals.

* * * * *